US011482814B2

(12) United States Patent
Kondo et al.

(10) Patent No.: US 11,482,814 B2
(45) Date of Patent: Oct. 25, 2022

(54) CONNECTOR WITH STRUCTURE FOR SUPPRESSING RATTLING OF THE SHIELD TERMINAL

(71) Applicant: SUMITOMO WIRING SYSTEMS, LTD., Mie (JP)

(72) Inventors: Yuki Kondo, Mie (JP); Yusuke Kojima, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/374,011

(22) Filed: Jul. 13, 2021

(65) Prior Publication Data

US 2022/0037837 A1 Feb. 3, 2022

(30) Foreign Application Priority Data

Jul. 28, 2020 (JP) ..... JP2020-127130

(51) Int. Cl.

*H01R 13/6588* (2011.01)
*H01R 13/508* (2006.01)
*H01R 13/40* (2006.01)
*H01R 13/422* (2006.01)
(Continued)

(52) U.S. Cl.

CPC ..... *H01R 13/6588* (2013.01); *H01R 13/40* (2013.01); *H01R 13/4223* (2013.01); *H01R 13/508* (2013.01); *H01R 9/0518* (2013.01); *H01R 13/6591* (2013.01)

(58) Field of Classification Search

CPC ..... H01R 13/6588; H01R 13/40; H01R 13/4223; H01R 13/508; H01R 9/0518; H01R 13/6591; H01R 12/724; H01R 13/6582; H01R 2103/00; H01R 13/02; H01R 13/424; H01R 13/4362; H01R 13/4364; H01R 13/4365; H01R 13/4367; H01R 13/4368

See application file for complete search history.

(56) References Cited

U.S. PATENT DOCUMENTS

2004/0132341 A1* 7/2004 Noguchi ..... H01R 13/6582 439/607.56
2020/0274265 A1* 8/2020 Hashimoto ..... H01R 13/6583
2021/0151923 A1* 5/2021 Maesoba ..... H01R 13/6592

FOREIGN PATENT DOCUMENTS

JP 2009-252379 A 10/2009

* cited by examiner

*Primary Examiner* — Travis S Chambers
(74) *Attorney, Agent, or Firm* — Venjuris, P.C.

(57) ABSTRACT

A connector structure includes a first housing, a first shield terminal to be accommodated into the first housing, a second housing connectable to the first housing, and a second shield terminal to be accommodated into the second housing. The first shield terminal includes first inner conductors and a first outer conductor. The second shield terminal includes second inner conductors and a second outer conductor. The first outer conductor includes a first fitting portion and a first non-fitting portion. The second outer conductor includes a second fitting portion and a cut portion. The first housing includes rattling suppressing portions for suppressing rattling of the first shield terminal by coming into contact with an exposed portion of the first fitting portion exposed from the cut portion and a locking lance for retaining the first shield terminal by being locked to a lance locking portion provided on the first non-fitting portion.

3 Claims, 11 Drawing Sheets

(51) Int. Cl.

| | |
|---|---|
| *H01R 9/05* | (2006.01) |
| *H01R 13/6591* | (2011.01) |

CONNECTOR WITH STRUCTURE FOR SUPPRESSING RATTLING OF THE SHIELD TERMINAL

CROSS-REFERENCE TO RELATED APPLICATIONS

This application is based on and claims priority from Japanese Patent Application No. 2020-127130, filed on Jul. 28, 2020, with the Japan Patent Office, the disclosure of which is incorporated herein in their entireties by reference.

TECHNICAL FIELD

The present disclosure relates to a connector structure.

BACKGROUND

Conventionally, an example of a shield connector is known from Japanese Patent Laid-open Publication No. 2009-252379. The shield connector described in Japanese Patent Laid-open Publication No. 2009-252379 includes a female connector and a male connector to be connected to each other.

The female connector includes a female shield terminal fixed to an end of a shielded cable and a female housing formed with a cavity into which the female shield terminal is inserted. A locking lance cantilevered and resiliently displaceable is formed at a position near a front end on the ceiling surface of the cavity. The locking lance is locked to a locking projection of the female shield terminal to retain the female shield terminal.

On the other hand, the male connector includes a male shield terminal and a male housing formed with a cavity into which the male shield terminal is press-fit.

SUMMARY

In the above configuration, since a part of the female shield terminal near the front end is locked by the locking lance, the female shield terminal is stably held in the cavity. However, it is assumed that, depending on design, the entire length of the female shield terminal is long and a rear side of the female shield terminal has to be locked by the locking lance. In such a case, since the female shield terminal is disposed to be cantilevered forward from the rear end of the female housing, the female shield terminal easily rattles. In this way, when the female housing and the male housing are connected, the female shield terminal and the male shield terminal may not be opposed to each other and a connecting operation may be hindered.

The present disclosure was completed on the basis of the above situation and aims to provide a connector structure in which the rattling of a terminal is suppressed.

The present disclosure is directed to a connector structure with a first housing, a first shield terminal to be accommodated into the first housing, a second housing connectable to the first housing, and a second shield terminal to be accommodated into the second housing, wherein the first shield terminal includes a first inner conductor and a first outer conductor for surrounding the first inner conductor via a first dielectric, the second shield terminal includes a second inner conductor and a second outer conductor for surrounding the second inner conductor via a second dielectric, the first outer conductor includes a first fitting portion to be fit to an inner peripheral side of the second outer conductor by connecting the first and second housings and a first non-fitting portion to be disposed outside the second outer conductor, the second outer conductor includes a second fitting portion to be fit to an outer peripheral side of the first fitting portion by connecting the first and second housings and a cut portion for partially exposing the first fitting portion by partially cutting the second fitting portion, and the first housing includes a rattling suppressing portion for suppressing rattling of the first shield terminal by coming into contact with an exposed portion of the first fitting portion exposed from the cut portion and a locking lance for retaining the first shield terminal by being locked to a lance locking portion provided on the first non-fitting portion.

According to the present disclosure, it is possible to provide a connector structure in which the rattling of a terminal is suppressed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
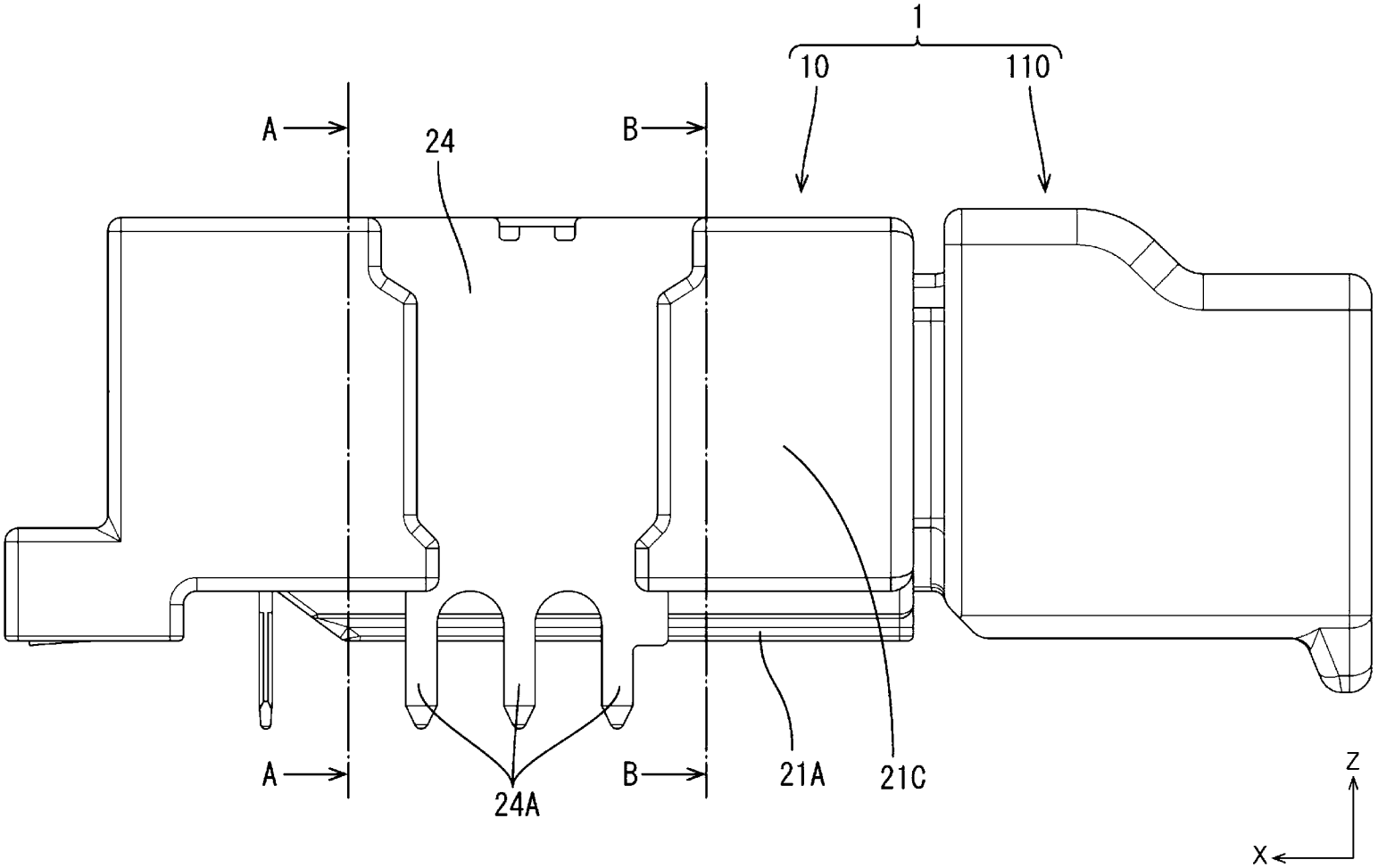
FIG. 1 is a side view of a connector structure according to an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF EMBODIMENTS OF PRESENT DISCLOSURE

First, embodiments of the present disclosure are listed and described.

(1) The connector structure of the present disclosure includes a first housing, a first shield terminal to be accommodated into the first housing, a second housing connectable to the first housing, and a second shield terminal to be accommodated into the second housing, the first shield terminal includes a first inner conductor and a first outer conductor for surrounding the first inner conductor via a first dielectric, the second shield terminal includes a second inner conductor and a second outer conductor for surrounding the second inner conductor via a second dielectric, the first outer conductor includes a first fitting portion to be fit to an inner peripheral side of the second outer conductor by connecting the first and second housings and a first non-fitting portion to be disposed outside the second outer conductor, the second outer conductor includes a second fitting portion to be fit to an outer peripheral side of the first fitting portion by connecting the first and second housings and a cut portion for partially exposing the first fitting portion by partially cutting the second fitting portion, and the first housing includes a rattling suppressing portion for suppressing rattling of the first shield terminal by coming into contact with an exposed portion of the first fitting portion exposed from the cut portion and a locking lance for retaining the first shield terminal by being locked to a lance locking portion provided on the first non-fitting portion.

According to this configuration, since the rattling suppressing portion comes into contact with the exposed portion of the first fitting portion, the rattling of the first shield terminal can be suppressed as compared to the case where only the outer surface of the first non-fitting portion is brought into contact with the first housing.

(2) Preferably, the first housing includes a contact portion for coming into contact with an outer surface of the first non-fitting portion, and the rattling suppressing portion and the locking lance are provided on a side opposite to the contact portion with the first outer conductor as a center.

According to this configuration, since the rattling suppressing portion is provided in a direction in which the locking lance is deflected and deformed and the first shield terminal easily rattles, the rattling of the first shield terminal can be effectively suppressed.

(3) Preferably, a pair of the rattling suppressing portions are provided on both lateral sides of the locking lance.

According to this configuration, the rattling suppressing portion can stably come into contact with the exposed portion of the first fitting portion.

DETAILS OF EMBODIMENT OF PRESENT DISCLOSURE

Hereinafter, an embodiment of the present disclosure is described. The present invention is not limited to these illustrations and is intended to be represented by claims and include all changes in the scope of claims and in the meaning and scope of equivalents.

Embodiment

The embodiment of the present disclosure is described with reference to FIGS. 1 to 11. A connector structure 1 of this embodiment is, for example, installed in a vehicle such as an automotive vehicle and disposed in a wired communication path between an in-vehicle electrical component (car navigation system, ETC, monitor or the like) in the vehicle and an external device (camera or the like) or between in-vehicle electrical components. In the following description, a direction indicated by an arrow Z is referred to as an upward direction, a direction indicated by an arrow X is referred to as a forward direction and a direction indicated by an arrow Y is referred to as a leftward direction. Note that only some of a plurality of identical members may be denoted by a reference sign and the other members may not be denoted by the reference sign.

[Connector Structure]

As shown in FIG. 1, the connector structure 1 includes a first connector 110 and a second connector 10 to be connected to the first connector 110.

[Second Shield Terminal]

Figure 5:
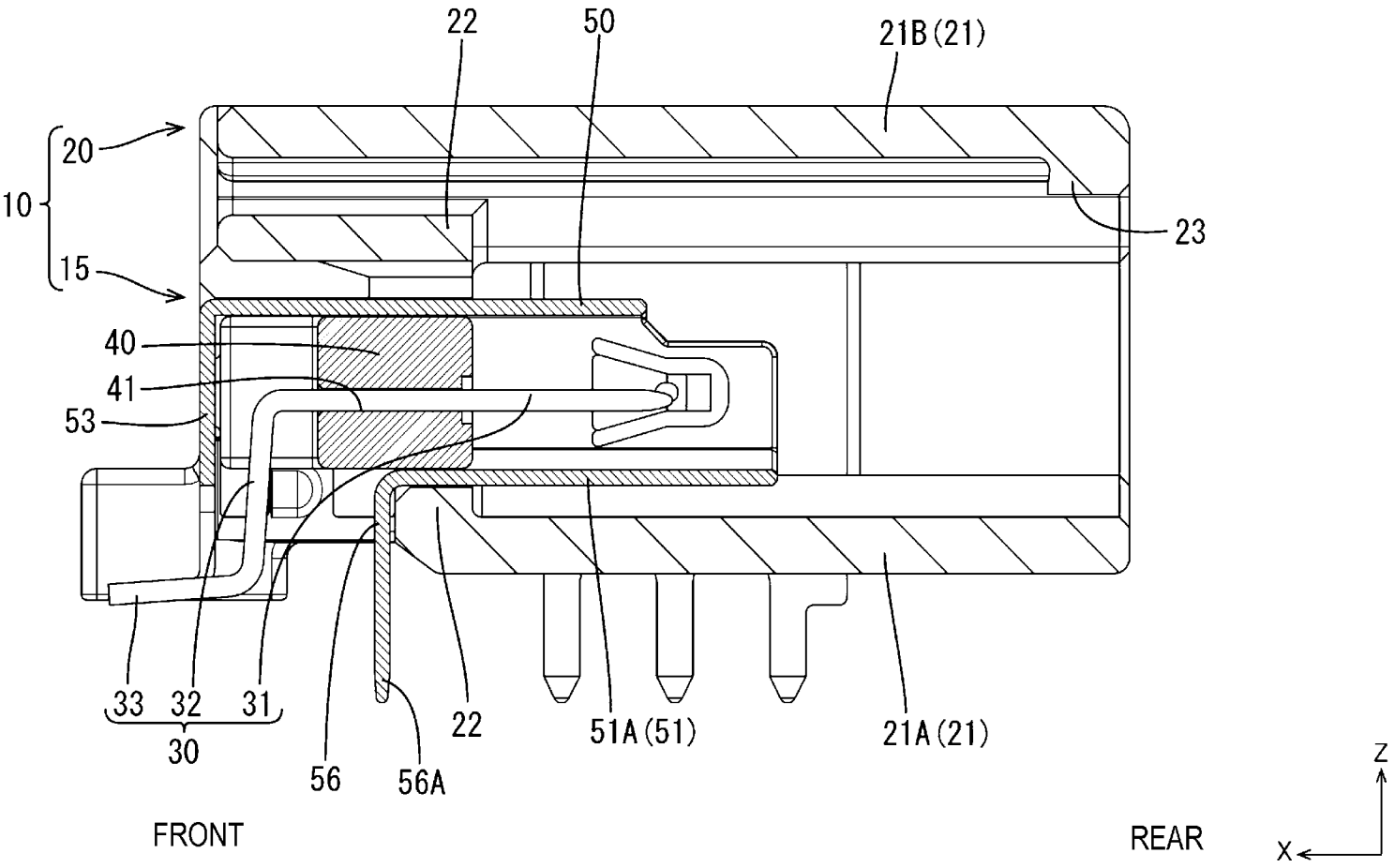
FIG. 5 is a section of a second connector in the cross-section along C-C of FIG. 2.
Figure 10:
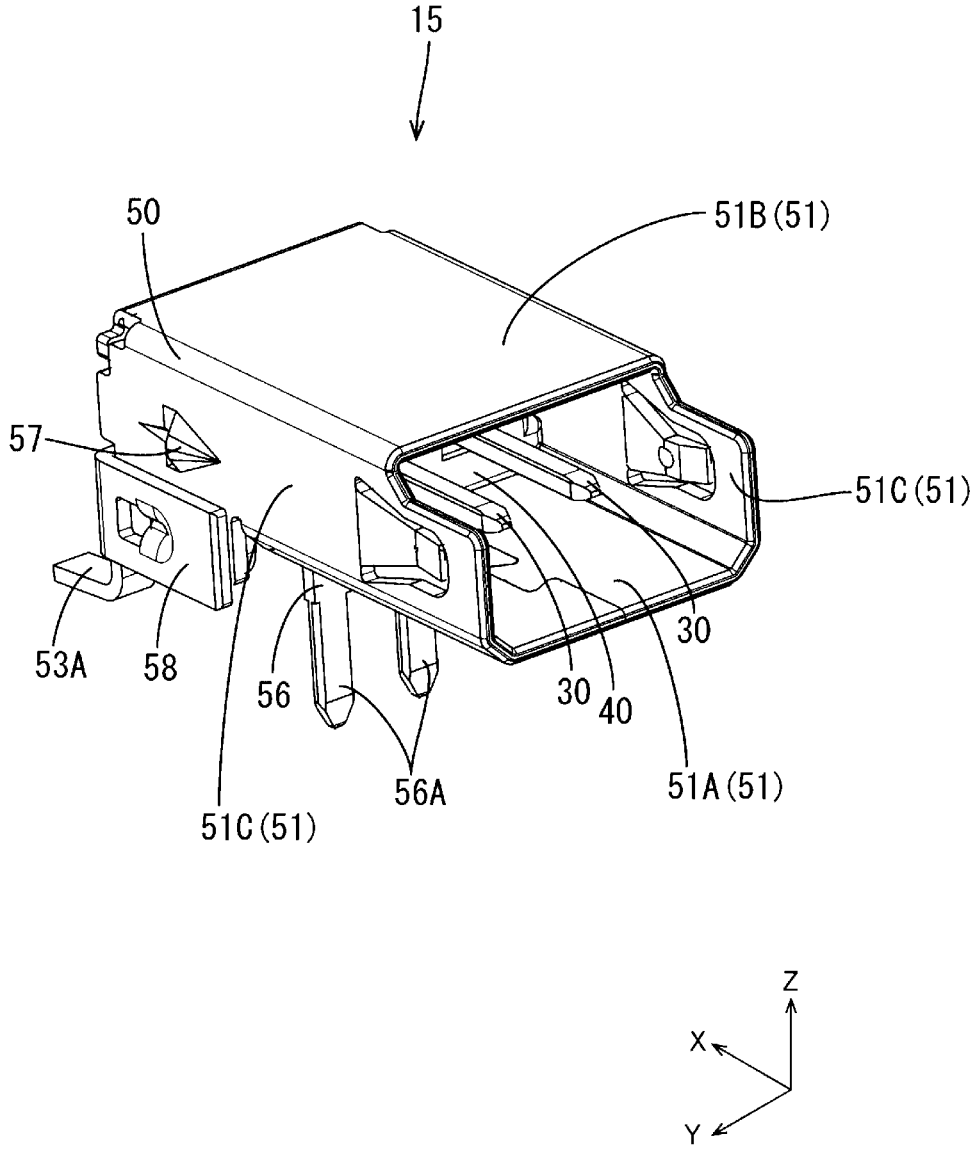
FIG. 10 is a perspective view of the second shield terminal.

As shown in FIG. 5, the second connector 10 is a board connector and includes a second shield terminal 15 to be connected to an unillustrated circuit board and a second housing 20 for accommodating the second shield terminal 15. The circuit board is a known one including a plurality of conductive paths, through holes, electronic components and the like, and disposed below the second connector 10 with a vertical direction aligned with a plate thickness direction. The second shield terminal 15 includes second inner conductors 30, a second dielectric 40 for accommodating the second inner conductors 30 and a second outer conductor 50 for covering the second dielectric 40. In this embodiment, the second inner conductors 30 are male terminals. As shown in FIG. 10, the second shield terminal 15 includes two second inner conductors 30.

[Second Inner Conductors]

Figure 4:
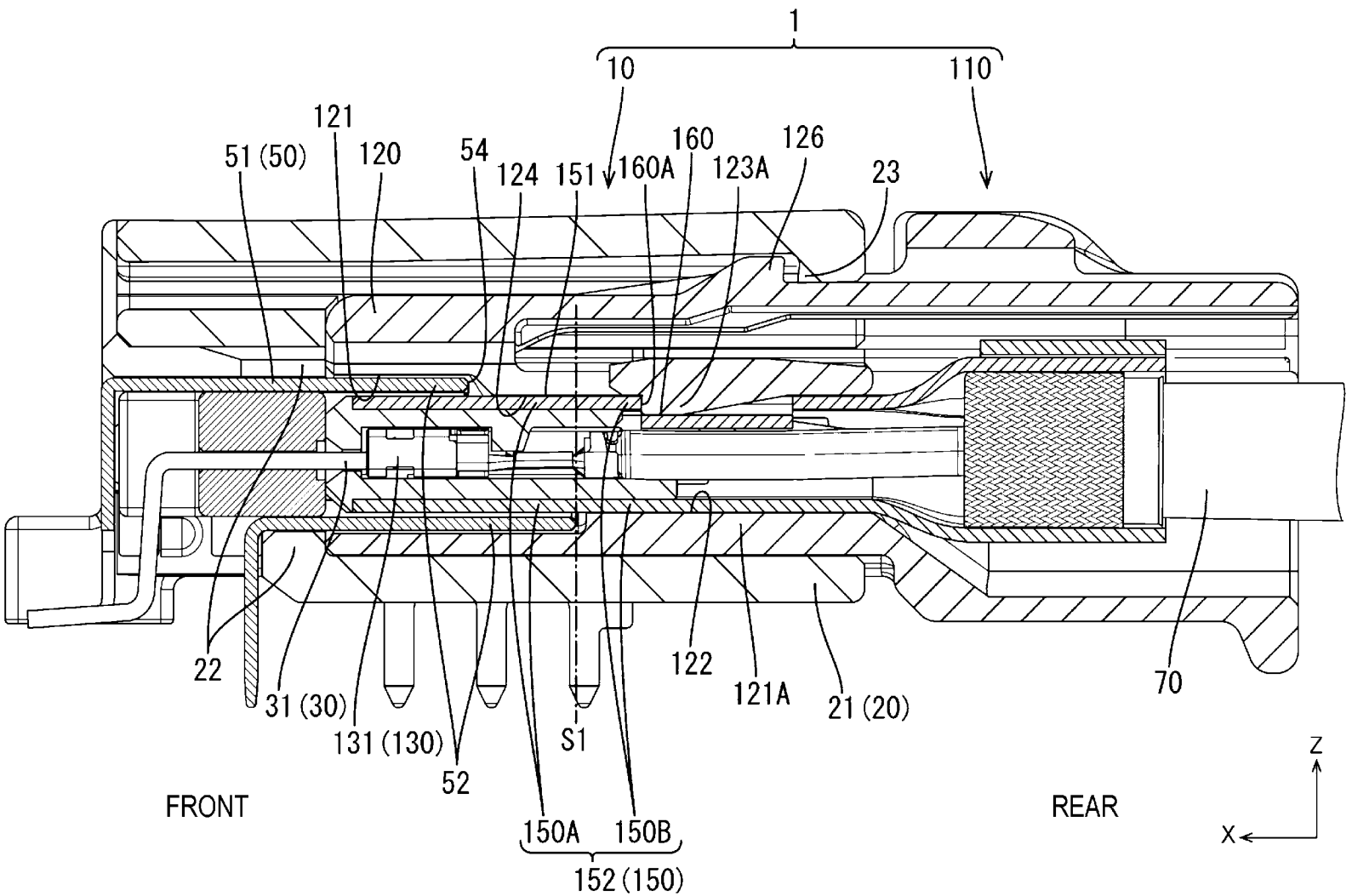
FIG. 4 is a section of the connector structure in a cross-section along C-C of FIG. 2.

The second inner conductor 30 is formed by working a conductive metal plate material. As shown in FIG. 5, the second inner conductor 30 includes a straight portion 31 extending rearward (rightward in FIG. 5), a bent portion 32 bent downward with respect to the straight portion 31 and a board connecting portion 33 extending forward (leftward in FIG. 5) from the bent portion 32. The board connecting portion 33 is connected to the conductive path for signal of the unillustrated circuit board by soldering. As shown in FIG. 4, the straight portion 31 is connected to a terminal connecting portion 131 of a first inner conductor 130.

[Second Dielectric]

The second dielectric 40 is made of insulating synthetic resin. As shown in FIG. 5, the second dielectric 40 includes cavities 41 for accommodating the second inner conductors 30. The cavities 41 are formed to penetrate through the second dielectric 40 in a front-rear direction. The second inner conductor 30 is press-fit from front to rear into the cavity 41 and held therein. If the second inner conductor 30 is accommodated into the cavity 41, the straight portion 31 projects rearward from the second dielectric 40. Although not shown, two cavities 41 are provided in the second dielectric 40. As shown in FIG. 10, the second dielectric 40 holds the two second inner conductors 30 in parallel in a lateral direction.

[Second Outer Conductor]

The second outer conductor 50 is formed by working a conductive metal plate material. As shown in FIG. 10, the second outer conductor 50 includes a second tubular portion 51 in the form of a rectangular tube. As shown in FIG. 5, the second dielectric 40 into which the second inner conductors 30 are press-fit is disposed in a front half of the second tubular portion 51. As shown in FIG. 4, a rear half of the second tubular portion 51 serves as a second fitting portion 52 and is fit to the outer peripheral surface of a first outer conductor 150.

As shown in FIG. 10, the second tubular portion 51 includes a bottom wall 51A forming a lower wall of the rectangular tube, a ceiling wall 51B facing the bottom wall 51A and two side walls 51C connecting the bottom wall 51A and the ceiling wall 51B. As shown in FIG. 5, the second tubular portion 51 is open rearward and, in a front part, open downward. A front end part of the second outer conductor 50 serves as a front wall 53 which comes into contact with a front end part of the second dielectric 40.

Figure 8:
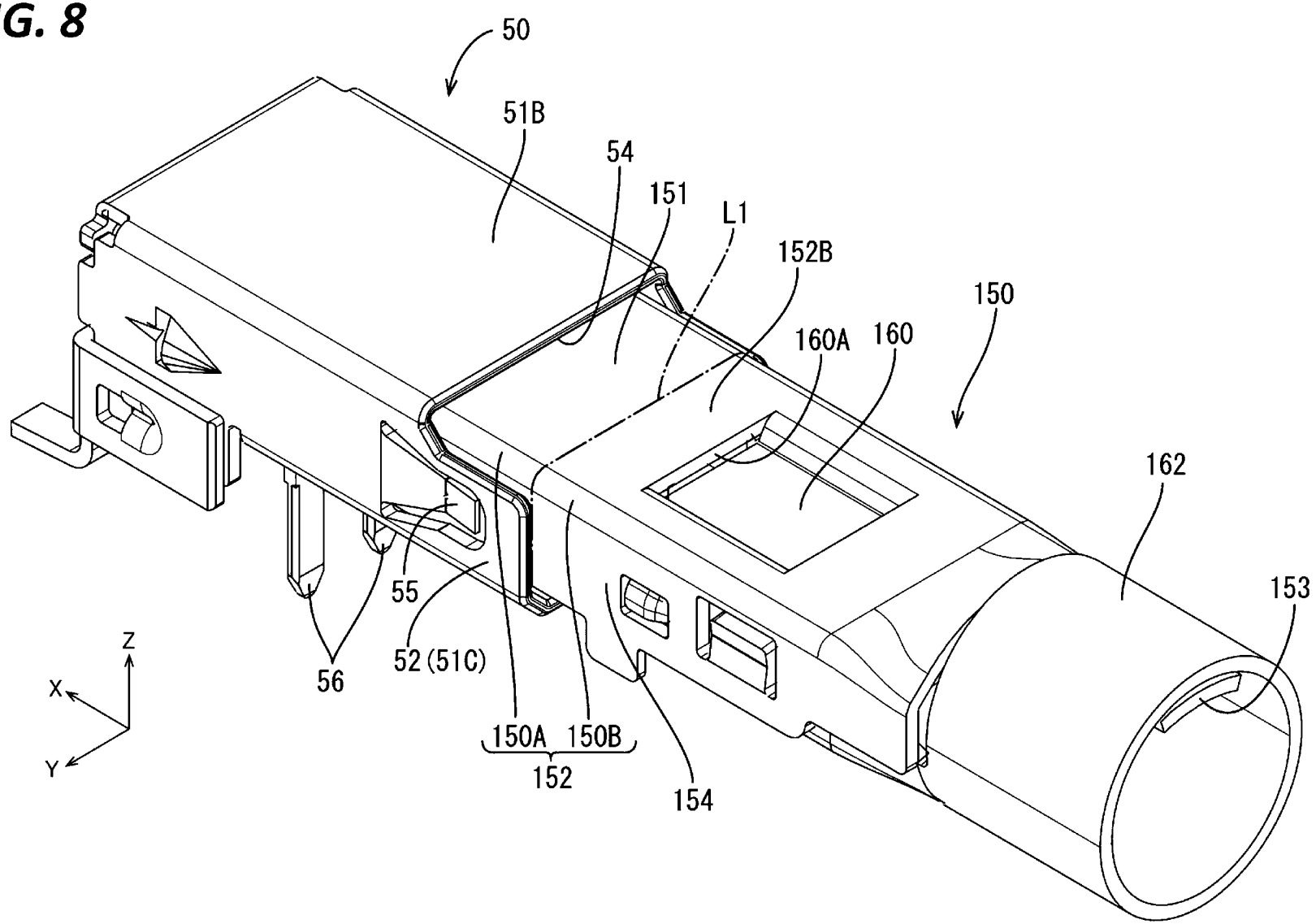
FIG. 8 is a perspective view showing a state where a first shield terminal and a second shield terminal are connected.
Figure 9:
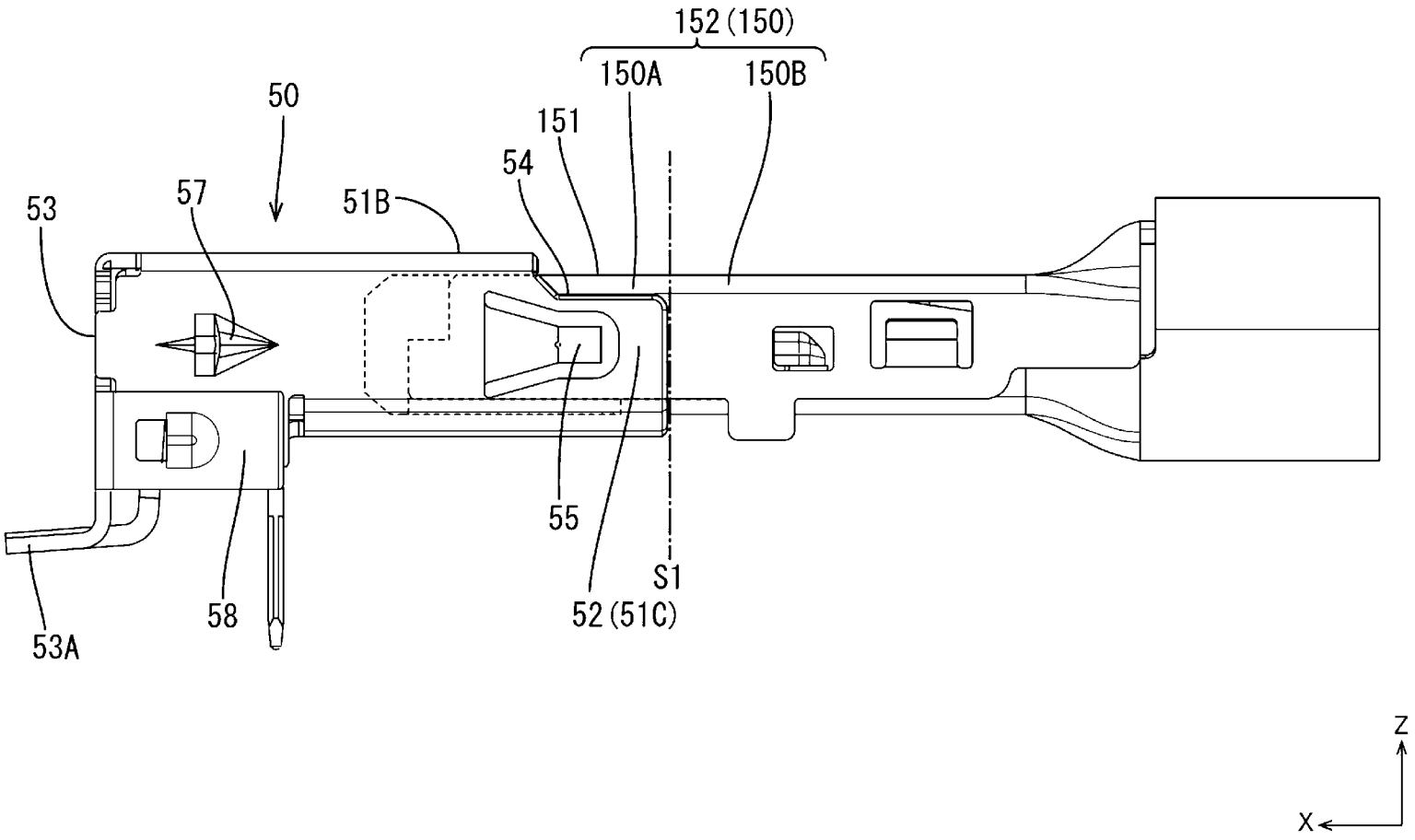
FIG. 9 is a side view showing the state where the first and second shield terminals are connected.

As shown in FIGS. 8 and 9, a cut portion 54 is formed on a rear side of the second fitting portion 52 by cutting upper end parts of the two side walls 51C and the ceiling wall 51B. With the first and second outer conductors 150, 50 fit, an exposing portion 151 (described in detail later) of the first outer conductor 150 is exposed from the cut portion 54. Contact pieces 55 are provided by cutting the two side walls 51C of the second fitting portion 52. As shown in FIG. 8, the contact piece 55 is bent inward to contact an outer side wall 154 of the first outer conductor 150. The first and second outer conductors 150, 50 are electrically connected by the contact pieces 55.

As shown in FIG. 5, the bottom wall 51A is bent downward on a front side to form a middle wall 56. The middle wall 56 includes pin-like press-fit portions 54A extending downward. As shown in FIG. 10, two press-fit portions 56A are provided on end parts in the lateral direction of the middle wall 56. The press-fit portions 56A are press-fit into the through holes of the circuit board and connected to the conductive paths for ground provided on the peripheral edges of the through holes.

As shown in FIG. 9, the front wall 53 is formed with ground connecting portions 53A extending downward and forward. Two ground connecting portions 53A are provided on end parts in the lateral direction, and the one on the left end (front side on the plane of FIG. 9) is seen in FIG. 9. A front end part of the ground connecting portion 53A is connected to the conductive path for ground of the unillustrated circuit board.

As shown in FIGS. 9 and 10, a press-fit projection 57 is formed to project outward on a front side of the side wall 51C. A stabilizer 58 is formed below the press-fit projection 57.

[Second Housing]

Figure 2:
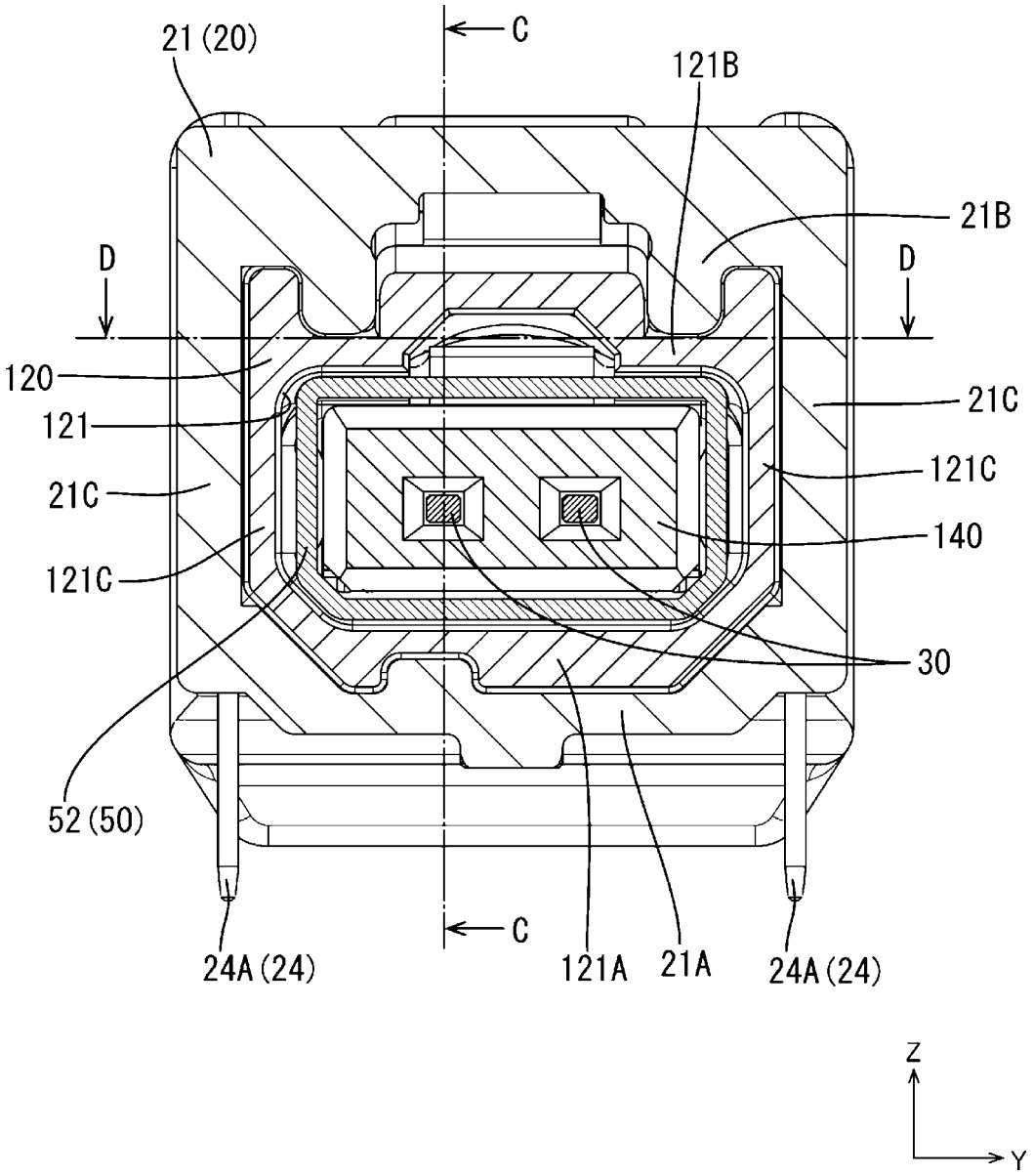
FIG. 2 is a section along A-A of FIG. 1.
Figure 3:
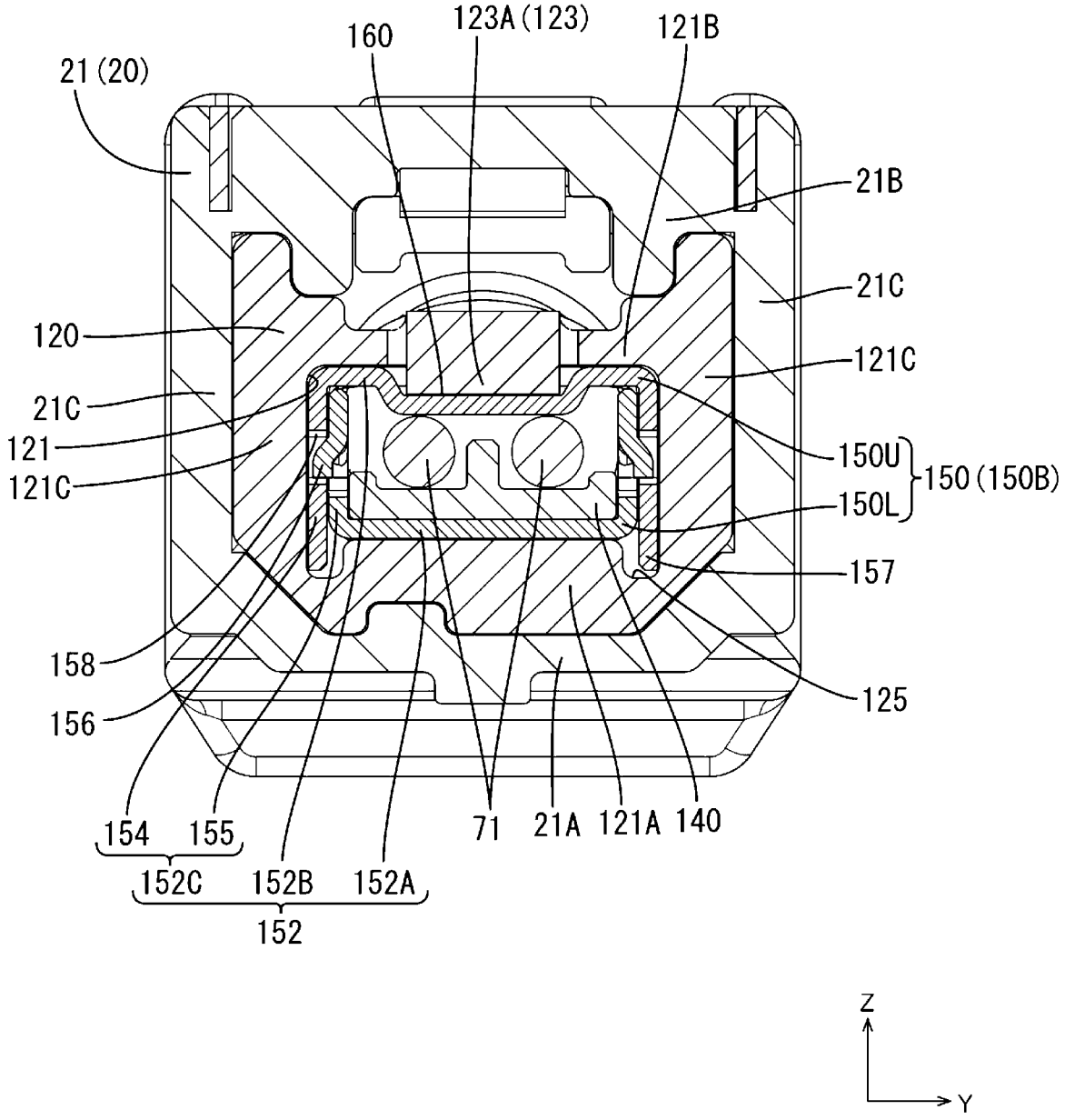
FIG. 3 is a section along B-B of FIG. 1.

The second housing 20 is made of insulating synthetic resin and includes, as shown in FIG. 4, a receptacle 21 into which the first connector 110 is fit from behind. As shown in FIGS. 2 and 3, the receptacle 21 includes a lower wall 21A, an upper wall 21B and two side walls 21C connecting the lower wall 21A and the upper wall 21B. As shown in FIG. 5, a back wall 22 projecting inwardly of the receptacle 21 is provided on a side somewhat forward of a center in the front-rear direction of the receptacle 21. A lock portion 23 is formed to project downward on the rear end edge of the upper wall 21B of the receptacle 21.

As shown in FIG. 5, the second shield terminal 15 is held in a front half of the second housing 20. The second shield terminal 15 is press-fit into the second housing 20 from front and inserted until the middle wall 56 comes into contact with the front end of the lower wall 21A. Although not shown, the second housing 20 includes a guiding groove engageable with the stabilizer 58 (see FIG. 9), and a press-fitting operation of the second shield terminal 15 is guided by the engagement of the stabilizer 58 and the guiding groove. As shown in FIG. 4, when the first and second connectors 110, 10 are connected, the front end of the first housing 120 comes into contact with the rear end of the back wall 22.

As shown in FIGS. 1 and 2, board mounting portions 24 are provided outside the side walls 21C. The board mounting portion 24 includes pin-like pegs 24A projecting further downward than the lower wall 21A. The pegs 24A are press-fit into the through holes of the circuit board and fixed (not shown).

Figure 6:
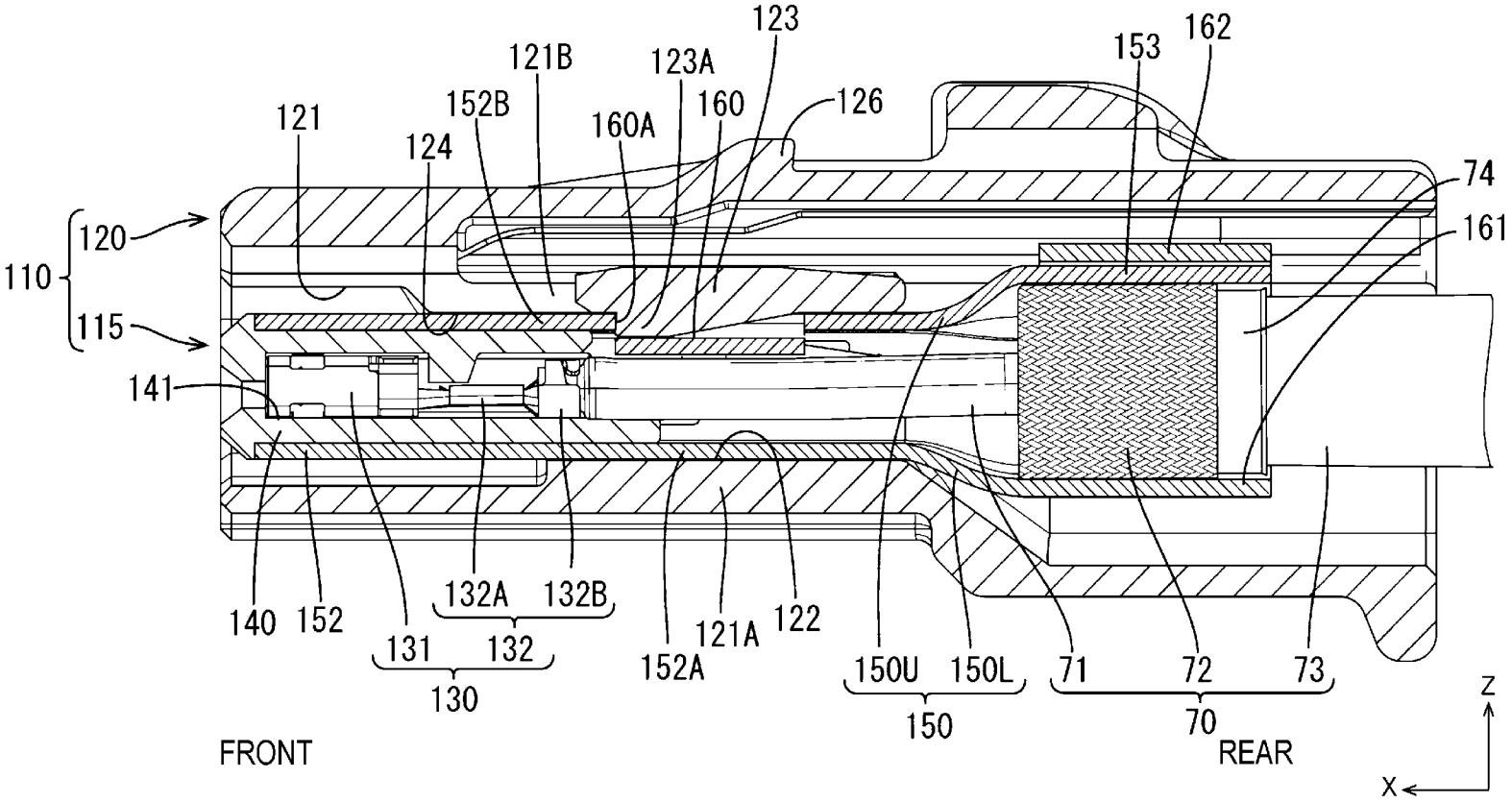
FIG. 6 is a section of a first connector in the cross-section along C-C of FIG. 2.

As shown in FIG. 6, a cable 70 includes two coated wires 71 (see FIG. 3), a shield body 72 made of a braided wire for collectively covering the outer peripheries of the two coated wires 71 and a sheath portion 73 made of an insulating coating for covering the outer periphery of the shield body 72.

As shown in FIG. 6, the sheath portion 73 and the shield body 72 are stripped to expose the coated wires 71 in a front end part of the cable 70. The shield body 72 exposed from the sheath portion 73 is folded on an end part of the sheath portion 73. A sleeve 74 made of metal is arranged inside the shield body 72 folded on the end part of the sheath portion 73. The sleeve 74 is formed into a hollow cylindrical shape by working a metal plate material.

[First Shield Terminal]

As shown in FIG. 6, the first connector 110 includes a first shield terminal 115 to be connected to the coated wires 71 exposed in the front end part of the cable 70 and a first housing 120 for accommodating the first shield terminal 115. The first shield terminal 115 includes the first inner conductors 130, a first dielectric 140 for accommodating the first inner conductors 130 and the first outer conductor 150 for covering the first dielectric 140. In this embodiment, the first inner conductors 130 are female terminals.

[First Inner Conductors]

The first inner conductor 130 is formed by working a conductive metal plate material. As shown in FIG. 6, the first inner conductor 130 includes the terminal connecting portion 131 in the form of a rectangular tube and a wire connecting portion 132 connected to and behind the terminal connecting portion 131.

The terminal connecting portion 131 includes an unillustrated resilient contact piece inside and is, as shown in FIG. 4, electrically connected to the second inner conductor 30. As shown in FIG. 6, the wire connecting portion 132 includes a core crimping portion 132A to be crimped to a core exposed in a front end part of the coated wire 71 and a coating crimping portion 132B to be crimped to an insulation coating. The first inner conductor 130 is electrically connected to the coated wire 71 by the wire connecting portion 132.

[First Dielectric]

Figure 11:
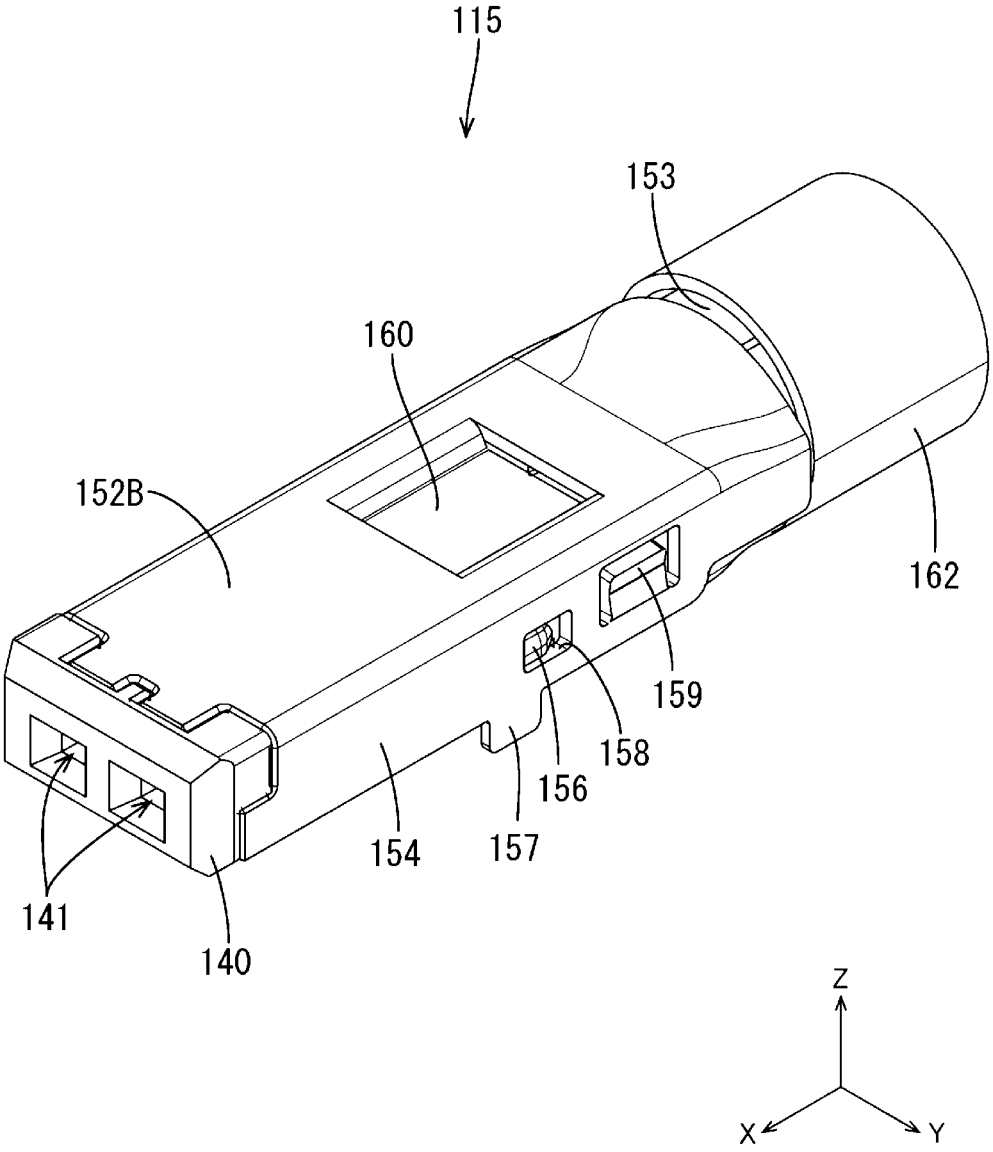
FIG. 11 is a perspective view of the first shield terminal.

The first dielectric 140 is made of insulating synthetic resin and, as shown in FIG. 6, formed into a rectangular parallelepiped shape long in the front-rear direction. The first dielectric 140 includes cavities 141 for accommodating the first inner conductors 130. As shown in FIG. 11, two cavities 141 are provided in parallel in the lateral direction in the first dielectric 140.

[First Outer Conductor]

As shown in FIGS. 3 and 6, the first outer conductor 150 includes a lower first outer conductor 150L and an upper first outer conductor 150U to be assembled with the lower first outer conductor 150L. The lower and upper first outer conductors 150L, 150U are formed by working a conductive metal plate material.

As shown in FIG. 6, the first outer conductor 150 includes a first tubular portion 152 for accommodating the coated wires 71, the first dielectric 140 and the like, and a shield connecting portion 153 to be connected to the shield body 72 of the cable 70.

The first tubular portion 152 is in the form of a rectangular tube long in the front-rear direction. The first dielectric 140 including the first inner conductors 130 is disposed inside a front half of the first tubular portion 152. The first tubular portion 152 and the first inner conductors 130 are electrically insulated by the first dielectric 140.

As shown in FIG. 3, the first tubular portion 152 includes a bottom wall 152A forming a lower wall of the rectangular tube, a ceiling wall 152B facing the bottom wall 152A and two side walls 152C connecting the bottom wall 152A and the ceiling wall 152B. The side wall 152C includes the outer side wall 154 facing the first housing 120 and an inner side wall 155 located inside the outer side wall 154. The bottom wall 152 and the inner side walls 154 are provided in the lower first outer conductor 150L, and the ceiling wall 152B and the outer side walls 154 are provided in the upper first outer conductor 150U.

As shown in FIGS. 4, 8 and 9, the first outer conductor 150 is fit to an inner peripheral side of the second fitting portion 52 of the second outer conductor 50. Dashed-dotted lines of FIGS. 4 and 9 indicate a virtual surface 51 in contact with the rear end of the second outer conductor 50 and orthogonal to a fitting direction (front-rear direction) with the first and second outer conductors 150, 50 fit. A part of the first tubular portion 152 forward of the virtual surface S1 serves as a first fitting portion 150A to be fit to the second fitting portion 52. A part of the first tubular portion 152 rearward of the virtual surface S1 serves as a first non-fitting portion 150B to be disposed outside the second fitting portion 52.

A dashed-dotted line of FIG. 8 is a boundary line L1 indicating a boundary between the first fitting portion 150A and the first non-fitting portion 150B. That is, a part of the first tubular portion 152 forward of the boundary line L1 is the first fitting portion 150A and a part of the first tubular portion 152 rearward of the boundary line L1 is the first non-fitting portion 150B. The outer surface of the first fitting portion 150A is partially exposed to outside and serves as an exposed portion 151 by providing the second outer conductor 50 with the cut portion 54.

As shown in FIG. 3, a projection 156 projecting outward is formed in a central part in the front-rear direction of the inner side wall 155. A slit 158 is formed in a central part in the front-rear direction of the outer side wall 154 to penetrate in the lateral direction. As shown in FIGS. 3 and 11, dimensions in the front-rear and vertical directions of the slit 158 are somewhat larger than those of the projection 156. In this way, the projection 156 is accommodated into the slit 158. As shown in FIG. 3, the upper and lower first outer conductors 150U, 150L are positioned by accommodating the projections 156 into the slits 158.

As shown in FIG. 3, the stabilizer 157 is provided to project downward in a central part in the front-rear direction of the outer side wall 154. As shown in FIG. 11, the outer side wall 154 behind the slit 158 is cut to form a locking piece 159. The locking piece 159 is folded inward and, although not shown, in contact with the inner side wall 155.

[Lance Locking Portion]

As shown in FIGS. 3 and 11, a recess concave downward is formed on a side of the ceiling wall 152B behind a central part in the front-rear direction. As shown in FIGS. 6 and 8, the ceiling wall 152B has cut surfaces in boundary parts with the recess 160 in the front-rear direction, and the front cut surface serves as a lance locking portion 160. As shown in FIG. 4, the recess 160 and the lance locking portion 160A are provided in the first non-fitting portion 150B.

As shown in FIG. 6, a rear end part of the ceiling wall 152B extends upward and is connected to the shield connecting portion 153. A rear end part of the bottom wall 152A extends downward and is connected to a barrel bottom wall 161. A barrel 162 extending from the barrel bottom wall 161 is crimped to the outer periphery of the shield body 72 folded on the cable 70, thereby being electrically connected and fixed to the shield body 72. As shown in FIGS. 8 and 11, the shield connecting portion 153 is wrapped inside the barrel 162. In this way, the shield connecting portion 153 is crimped and electrically connected to the shield body 72 of the cable 70 as shown in FIG. 6.

[First Housing 120]

The first housing 120 is made of insulating synthetic resin and includes, as shown in FIG. 6, an accommodating portion 121 for accommodating the first shield terminal 115. The accommodating portion 121 is formed to penetrate in the front-rear direction. A peripheral wall constituting the accommodating portion 121 includes a lower wall 121A, an upper wall 121B and two side walls 121C connecting the lower wall 121A and the upper wall 121B as shown in FIGS. 2 and 3.

As shown in FIG. 3, the inner peripheral shape in a central part in the front-rear direction of the accommodating portion 121 is somewhat larger than the outer peripheral shape of the first non-fitting portion 150B of the first outer conductor 150. The accommodating portion 121 is formed with guide grooves 125 extending in the front-rear direction at positions corresponding to the stabilizers 157. The stabilizers 157 contact the inner surfaces of the guide grooves 125, whereby an inserting operation of the first outer conductor 150 into the first housing 120 is guided.

As shown in FIGS. 2 and 4, the inner peripheral shape of a front part of the accommodating portion 121 is somewhat larger than the outer peripheral shape of the second fitting portion 52 of the second outer conductor 50. In this way, the first and second outer conductors 150, 50 can be fit in the front part of the accommodating portion 121 as shown in FIG. 4.

[Contact Portion]

As shown in FIG. 6, the lower wall 121A is provided with a contact portion 122 which comes into contact with the outer surface of the bottom wall 152A of the first outer conductor 150. As shown in FIG. 4, the contact portion 122 is in contact with the outer surface of a lower part of the first non-fitting portion 150B.

[Locking Lance]

Figure 7:
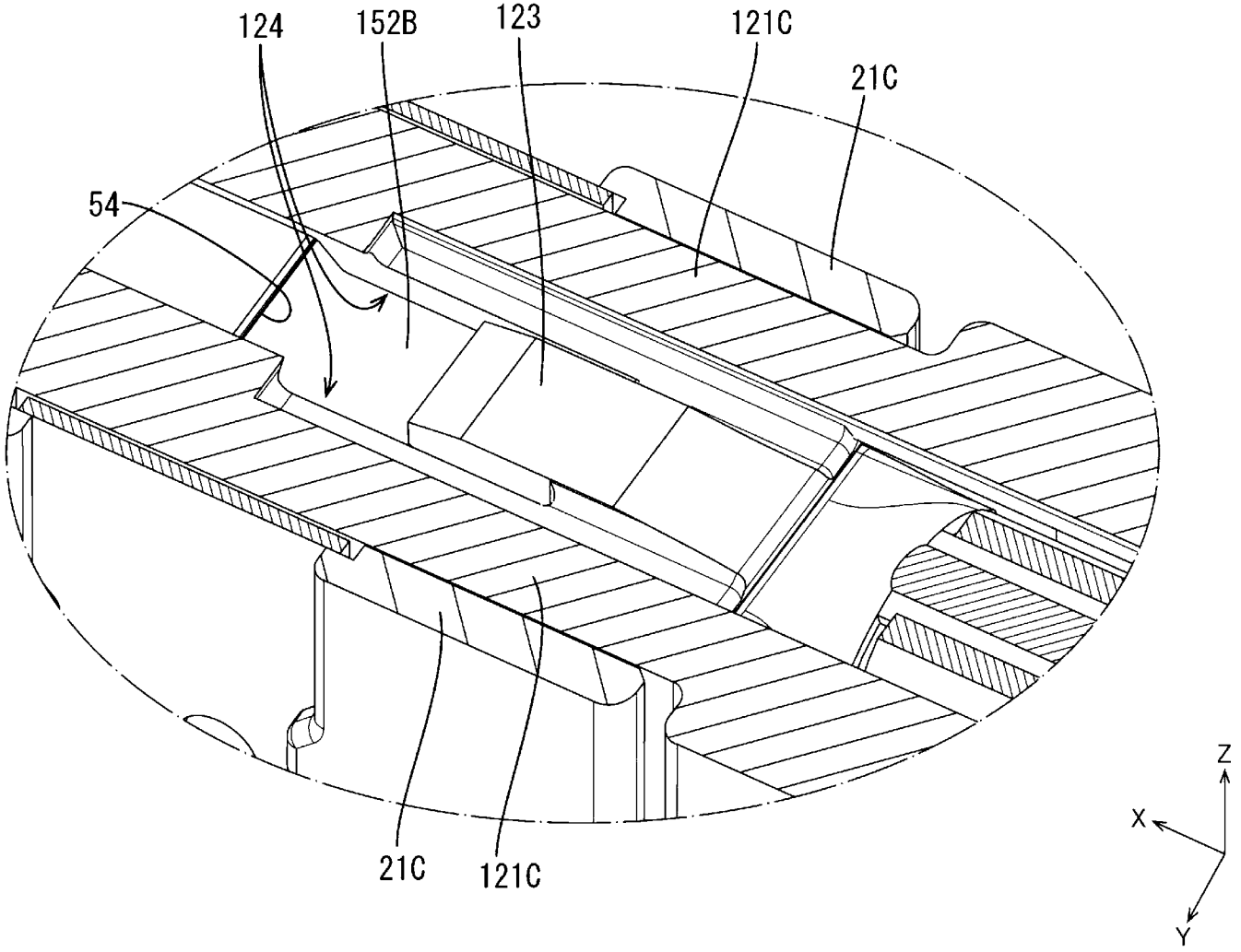
FIG. 7 is a perspective view in section of the connector structure in a cross-section along D-D of FIG. 2.

As shown in FIG. 3, the upper wall 121B is formed with a locking lance 123. As shown in FIG. 7, the locking lance 123 is cantilevered forward with a rear end part thereof connected to the two side walls 121C. In this way, the locking lance 123 is resiliently displaceable in the vertical direction with the rear end part as a fulcrum. As shown in FIG. 6, the locking lance 123 includes a projecting portion 123A projecting downward. The projecting portion 123A is fit into the recess 160 of the first outer conductor 150. If the first shield terminal 115 is accommodated at a proper accommodation position of the accommodating portion 121, the projecting portion 123A is locked to the lance locking portion 160A to retain the first shield terminal 115.

[Rattling Suppressing Portions]

As shown in FIG. 6, the upper wall 121B is provided with rattling suppressing portions 124 extending forward of the locking lance 123. As shown in FIG. 7, a pair of the rattling suppressing portions 124 are formed on both left and right sides of the locking lance 123. As shown in FIG. 6, the rattling suppressing portions 124 are in contact with the outer surface of the ceiling wall 152B of the first outer conductor 150. As shown in FIG. 4, the rattling suppressing portions 124 can come into contact with the exposed portion 151 (see FIG. 8) of the first fitting portion 150A in addition to the outer surface of the first non-fitting portion 150B by providing the second outer conductor 50 with the cut portion 54.

As shown in FIG. 6, a lock arm 126 is provided to project upward in a central part in the front-rear direction of an upper outer wall of the first housing 120. As shown in FIG.

4, when the first and second connectors 110, 10 are connected, the lock arm 126 is engaged with the lock portion 23 of the second housing 20, whereby the first connector 110 is held inside the receptacle 21.

[Connection of First Connector and Second Connector]

The second connector 10 connected and fixed to the circuit board (not shown) and the first connector 110 connected to the end of the cable 70 are connected (FIG. 4). In the first connector 110, the projecting portion 123A of the locking lance 123 is fit into the recess 160 on the rear side (first non-fitting portion 150B) of the first outer conductor 150, for example, due to design restrictions such as a height reduction (see FIGS. 4 and 6). In a connector (first connector) in which a rear half of a terminal is held by a locking lance of a housing, it is considered, in the conventional technique, that the terminal rattles in a deflection direction of the locking lance with a rear half thereof as a fulcrum and cannot be properly connected due to a connecting operation of the connector (first connector) and a mating connector (second connector) and the like.

However, in the first connector 110 of this embodiment, since the rattling suppressing portions 124 are provided to extend forward of the locking lance 123 as shown in FIG. 6, the front side (first fitting portion 150A) of the first outer conductor 150 can be pressed by the rattling suppressing portions 124 and the fulcrum where the first shield terminal 115 rattles can be moved forward. Further, since the second fitting portion 52 of the second outer conductor 50 includes the cut portion 54 in the second connector 10 as shown in FIG. 4, the rattling suppressing portions 124 and the second fitting portion 52 do not interfere with each other when the first connector 110 and the second connector 10 are connected. Therefore, by providing the rattling suppressing portions 124, the rattling of the first shield terminal 115 is suppressed and the connection of the first and second connectors 110, 10 is facilitated.

Functions of Embodiment

According to this embodiment, the following functions and effects are achieved.

The connector structure 1 according to this embodiment includes the first housing 120, the first shield terminal 115 to be accommodated into the first housing 120, the second housing 20 connectable to the first housing 120 and the second shield terminal 15 to be accommodated into the second housing 20, the first shield terminal 115 includes the first inner conductors 130 and the first outer conductor 150 for surrounding the first inner conductors 130 via the first dielectric 140, the second shield terminal 15 includes the second inner conductors 30 and the second outer conductor 50 for surrounding the second inner conductors 30 via the second dielectric 40, the first outer conductor 150 includes the first fitting portion 150A to be fit to the inner peripheral side of the second connector 50 by connecting the first and second housings 120, 20 and the first non-fitting portion 150B to be disposed outside the second outer conductor 50, the second outer conductor 50 includes the second fitting portion 52 to be fit to the outer peripheral side of the first fitting portion 150A by connecting the first and second housings 120, 20 and the cut portion 54 for partially exposing the first fitting portion 150A by partially cutting the second fitting portion 52, and the first housing 120 includes the rattling suppressing portions 124 for suppressing the rattling of the first shield terminal 115 by coming into contact with the exposed portion 151 of the first fitting portion 150A exposed from the cut portion 54 and the locking lance 123 for retaining the first shield terminal 115 by being locked to the lance locking portion 160A provided on the first non-fitting portion 150B.

According to the above configuration, since the rattling suppressing portions 124 come into contact with the exposed portion 151 of the first fitting portion 150A, the rattling of the first shield terminal 115 can be suppressed as compared to the case where only the outer surface of the first non-fitting portion 150B is brought into contact with the first housing 120.

In this embodiment, the first housing 120 includes the contact portion 122 for coming into contact with the outer surface of the first non-fitting portion 150B, and the rattling suppressing portions 124 and the locking lance 123 are provided on a side opposite to the contact portion 122 with the first outer conductor 150 as a center.

According to the above configuration, since the rattling suppressing portions 124 are provided in a direction in which the locking lance 123 is deflected and deformed and the first shield terminal 115 easily rattles, the rattling of the first shield terminal 115 can be effectively suppressed.

In this embodiment, the pair of rattling suppressing portions 124 are provided on both lateral sides of the locking lance 123.

According to the above configuration, the rattling suppressing portions 124 can stably come into contact with the exposed portion 151 of the first fitting portion 150A.

Other Embodiments (1) Although the first inner conductors 130 are female terminals and the second inner conductors 30 are male terminals in the above embodiment, there is no limitation to this and first inner conductors may be male terminals and second inner conductors may be female terminals.

(2) Although the first connector 110 is connected to the cable 70 including the two coated wires 71 in the above embodiment, there is no limitation to this and a cable may include one, three or more coated wires.

(3) Although the second connector 10 is a board connector in the above embodiment, there is no limitation to this and a second connector may be connected to a cable.

(4) Although the first outer conductor 150 is formed by assembling the lower first outer conductor 150L and the upper first outer conductor 150U in the above embodiment, there is no limitation to this and a first outer conductor may be formed by one member.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector structure, comprising:

a first housing;

a first shield terminal to be accommodated into the first housing;

a second housing connectable to the first housing; and a second shield terminal to be accommodated into the second housing, wherein:

the first shield terminal includes a first inner conductor and a first outer conductor for surrounding the first inner conductor via a first dielectric, the second shield terminal includes a second inner conductor and a second outer conductor for surrounding the second inner conductor via a second dielectric, the first outer conductor includes a first fitting portion to be fit to an inner peripheral side of the second outer conductor by connecting the first and second housings and a first non-fitting portion to be disposed outside the second outer conductor, the second outer conductor includes a second fitting portion to be fit to an outer peripheral side of the first fitting portion by connecting the first and second housings and a cut portion for partially exposing the first fitting portion by partially cutting the second fitting portion, and the first housing includes a rattling suppressing portion for suppressing rattling of the first shield terminal by coming into contact with an exposed portion of the first fitting portion exposed from the cut portion and a locking lance for retaining the first shield terminal by being locked to a lance locking portion provided on the first non-fitting portion.

2. The connector structure of claim 1, wherein:

the first housing includes a contact portion for coming into contact with an outer surface of the first non-fitting portion, and the rattling suppressing portion and the locking lance are provided on a side opposite to the contact portion with the first outer conductor as a center.

3. The connector structure of claim 2, wherein a pair of the rattling suppressing portions are provided on both lateral sides of the locking lance.

* * * * *